US010255897B2

(12) United States Patent
Woelfl

(10) Patent No.: US 10,255,897 B2
(45) Date of Patent: Apr. 9, 2019

(54) ARRANGEMENTS AND METHODS FOR 3D AUDIO GENERATION

(71) Applicant: Harman Becker Automotive Systems GmbH, Karlsbad (DE)

(72) Inventor: Genaro Woelfl, Salching (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/860,468

(22) Filed: Jan. 2, 2018

(65) Prior Publication Data

US 2018/0192227 A1 Jul. 5, 2018

(30) Foreign Application Priority Data

Jan. 4, 2017 (EP) ..... 17150264

(51) Int. Cl.
*H04R 5/02* (2006.01)
*G10K 11/178* (2006.01)
(Continued)

(52) U.S. Cl.
CPC ..... *G10K 11/17815* (2018.01); *G10K 1/38* (2013.01); *G10K 11/17827* (2018.01);
(Continued)

(58) Field of Classification Search
CPC ..... H04S 7/304; H04S 3/008; H04S 2400/01; H04S 2400/11; H04S 2420/01;
(Continued)

(56) References Cited

U.S. PATENT DOCUMENTS 5,357,585 A * 10/1994 Kumar ..... H04R 1/1008 379/430
6,038,330 A * 3/2000 Meucci, Jr. ..... H04R 1/1075 345/8
(Continued)

FOREIGN PATENT DOCUMENTS

EP 2611214 A1 7/2013
WO 0163967 A1 8/2001
WO 2016001909 A1 1/2016

OTHER PUBLICATIONS

Woelfl, G. et al., "Systems and Methods for Generating Natural Directional Pinna Cues for Virtual Sound Source Synthesis," U.S. Appl. No. 15/860,451, filed Jan. 2, 2018, 120 pages.
(Continued)

*Primary Examiner* — Andrew L Sniezek
(74) *Attorney, Agent, or Firm* — McCoy Russell LLP

(57) ABSTRACT

A headset arrangement for virtual reality, augmented reality or mixed reality applications is configured to induce natural directional pinna cues. The arrangement comprises a support structure configured to be arranged on a user's head and to hold a display in front of the user's eyes. For each ear, the support structure comprises at least a first sound source and a second sound source, wherein, when the support structure is arranged on a user's head, the first sound source and the second sound source are arranged such that at the concha of the user a primary sound incidence direction of sound emitted by the first sound source is essentially opposing to a primary sound incidence direction of sound emitted by the second sound source. The primary sound incidence direction is the direction from which the sound emitted by a sound source reaches the concha for the first time.

15 Claims, 7 Drawing Sheets

(51) Int. Cl.

| | |
|---|---|
| ***H04R 1/02*** | (2006.01) |
| ***H04R 5/033*** | (2006.01) |
| ***H04S 5/02*** | (2006.01) |
| ***H04S 7/00*** | (2006.01) |
| ***H04R 5/04*** | (2006.01) |
| ***H04S 3/00*** | (2006.01) |
| ***H04R 1/10*** | (2006.01) |
| ***H04R 3/02*** | (2006.01) |
| ***G10K 1/38*** | (2006.01) |

(52) U.S. Cl.
CPC ..... *G10K 11/17881* (2018.01); *H04R 1/028* (2013.01); *H04R 1/1008* (2013.01); *H04R 1/1083* (2013.01); *H04R 3/02* (2013.01); *H04R 5/02* (2013.01); *H04R 5/033* (2013.01); *H04R 5/04* (2013.01); *H04S 3/008* (2013.01); *H04S 5/02* (2013.01); *H04S 7/304* (2013.01); *H04S 7/306* (2013.01); *G10K 11/178* (2013.01); *G10K 2210/1081* (2013.01); *G10K 2210/128* (2013.01); *G10K 2210/3026* (2013.01); *G10K 2210/3044* (2013.01); *G10K 2210/3046* (2013.01); *H04R 2205/022* (2013.01); *H04R 2460/01* (2013.01); *H04R 2499/13* (2013.01); *H04S 2400/01* (2013.01); *H04S 2400/11* (2013.01); *H04S 2420/01* (2013.01)

(58) Field of Classification Search
CPC ..... H04S 5/02; H04S 7/306; H04R 5/033; H04R 5/04; H04R 2499/13; H04R 2460/01; H04R 1/028; H04R 1/1008; H04R 1/1083; H04R 3/02; H04R 5/02; H04R 2205/022; G10K 2210/3046; G10K 2210/3044; G10K 2210/3026; G10K 2210/128; G10K 2210/1081; G10K 11/178; G10K 11/17815; G10K 11/17851; G10K 11/17827; G10K 1/38
See application file for complete search history.

(56) References Cited

U.S. PATENT DOCUMENTS

| | | | | |
|---|---|---|---|---|
| 7,532,734 | B2 * | 5/2009 | Pham | H04R 1/1075 381/370 |
| 9,131,310 | B2 * | 9/2015 | Sjoman | H04R 1/1075 |
| 9,635,450 | B2 * | 4/2017 | Drinkwater | H04R 1/105 |
| 2004/0032964 | A1 * | 2/2004 | Liang | H04R 5/0335 381/370 |
| 2017/0195795 | A1 * | 7/2017 | Mei | H04R 5/0335 |
| 2017/0332186 | A1 * | 11/2017 | Riggs | H04S 7/301 |

OTHER PUBLICATIONS

Woelfl, G. et al., "Arrangements and Methods for Active Noise Cancelling," U.S. Appl. No. 15/860,546, filed Jan. 2, 2018, 36 pages.

Woelfl, G. et al., "Arrangements and Methods for Generating Natural Directional Pinna Cues," U.S. Appl. No. 15/860,489, filed Jan. 2, 2018, 61 pages.

European Patent Office, Extended European Search Report Issued in Application No. 17209911.1, dated Feb. 8, 2018, Germany, 10 pages.

* cited by examiner

ARRANGEMENTS AND METHODS FOR 3D AUDIO GENERATION

CROSS REFERENCE TO RELATED APPLICATIONS

The present application claims priority to European Patent Application No. EP17150264.4 entitled "ARRANGEMENTS AND METHODS FOR GENERATING NATURAL DIRECTIONAL PINNA CUES", and filed on Jan. 4, 2017. The entire contents of the above-listed application are hereby incorporated by reference for all purposes.

TECHNICAL FIELD

The disclosure relates to arrangements and methods for 3D audio generation, in particular for 3D audio generation for virtual and augmented reality applications.

BACKGROUND

Virtual reality (VR) and augmented reality (AR) applications have become more and more popular. Virtual reality typically refers to computer technologies that use software to generate realistic images, sounds and other sensations that replicate a real environment, or create an imaginary setting, and simulate a user's physical presence in this environment, by enabling the user to interact with this space and any objects depicted therein using specialized display screens or projectors and other devices. Virtual reality equipment usually includes a headset that may be arranged on the user's head. The headset holds a display in position in front of the user's eyes and in some cases provides loudspeakers for generating a suitable sound experience. Often, VR headsets are combined with standard headphones. Most headphones available on the market today produce an in-head sound image when driven by a conventionally mixed stereo signal. "In-head sound image" in this context means that the predominant part of the sound image is perceived as being originated inside the user's head, usually on an axis between the ears. If sound is externalized by suitable signal processing methods (externalizing in this context means the manipulation of the spatial representation in a way such that the predominant part of the sound image is perceived as being originated outside the user's head), the center image tends to move mainly upwards instead of moving towards the front of the user. While especially binaural techniques based on HRTF filtering are very effective in externalizing the sound image and even positioning virtual sound sources on most positions around the user's head, such techniques usually fail to position virtual sources correctly on a frontal part of the median plane (in front of the user).

This means that acoustic events from the front, which is arguably the most important direction for VR environments and AR applications, currently cannot be reliably reproduced at the correct position when played over commercially available headphones. Generally, the visual content of VR or AR applications may help to improve frontal localization. However, visible sound sources for all sounds in front of the user are not necessarily present in VR and AR applications. In some embodiments of the present disclosure the localization of sound sources in front of the user may be improved if combined with suitable signal processing. Besides the optimization of spatial sound aspects for VR and AR applications, ease of use and wearing comfort are further important factors for VR and AR headsets. Loudspeakers that are integrated into VR and AR headsets generally help to prevent the clutter that may result when two devices are worn on top of each other (VR/AR headset and headphones). Current arrangements that try to integrate loudspeakers into the VR/AR headsets suffer from a degradation of special sound aspects, especially perceived source direction and limited low frequency output. In order to avoid the degradation of localization performance, an individual compensation of the transfer functions between the loudspeakers and the ears may be used for each user. The proposed sound source arrangements do not require individual transfer function compensation and, therefore, can avoid the corresponding measurement procedure as well as measurement hardware.

SUMMARY

A headset arrangement for virtual reality, augmented reality or mixed reality applications is configured to induce natural directional pinna cues. The arrangement comprises a support structure configured to be arranged on a user's head and to hold a display in front of the user's eyes. For each ear, the support structure comprises at least a first sound source and a second sound source, wherein, when the support structure is arranged on a user's head, the first sound source and the second sound source are arranged such that at the concha of the user a primary sound incidence direction of sound emitted by the first sound source is essentially opposing to a primary sound incidence direction of sound emitted by the second sound source. The primary sound incidence direction is the direction from which the sound emitted by a sound source reaches the concha for the first time.

Other systems, methods, features and advantages will be or will become apparent to one with skill in the art upon examination of the following detailed description and figures. It is intended that all such additional systems, methods, features and advantages be included within this description, be within the scope of the disclosure and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Many virtual reality (VR) and augmented reality (AR) headsets today rely on additional conventional headphones to generate sound for VR and AR applications. Only few VR and AR headsets have loudspeakers directly integrated into the support structure of the headset that is worn on the head to hold the display in place in front of the user's eyes. Usually, an additional headphone has to be worn by the user.

Figure 1:
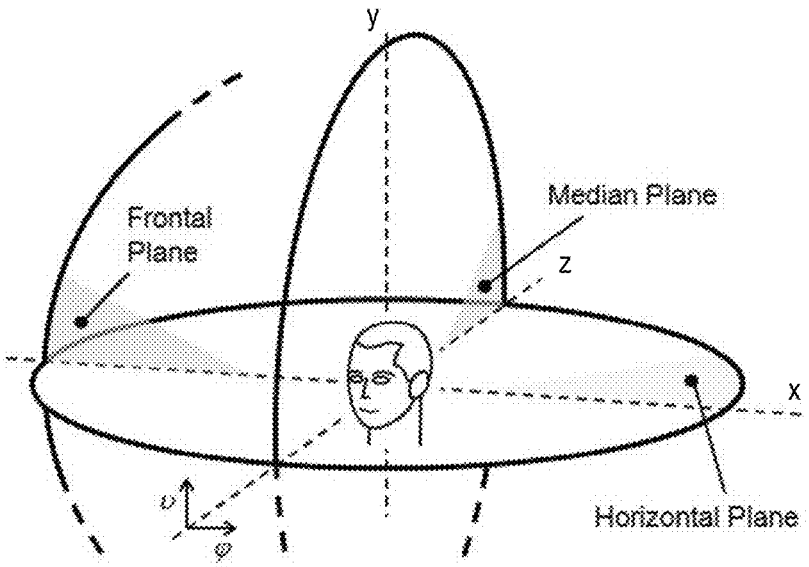
FIG. 1 schematically illustrates different planes and angles for source localization.

Sound source positions in the space surrounding the user can be described by means of an azimuth angle φ (position left to right), an elevation angle υ (position up and down) and a distance measure (distance of the sound source from the user). The azimuth and the elevation angle are usually sufficient to describe the direction of a sound source. The human auditory system uses several cues for sound source localization, including interaural time difference (ITD), interaural level difference (ILD), and pinna resonance and cancellation effects, that are all combined within the head related transfer function (HRTF). FIG. 1 illustrates the planes of source localization, namely a horizontal plane (also called transverse plane) which is generally parallel to the ground surface and which divides the user's head in an upper part and a lower part, a median plane (also called midsagittal plane) which is perpendicular to the horizontal plane and, therefore, to the ground surface and which crosses the user's head midway between the user's ears, thereby dividing the head in a left side and a right side, and a frontal plane (also called coronal plane) which equally divides anterior aspects and posterior aspects and which lies at right angles to both the horizontal plane and the median plane. Azimuth angle φ and elevation angle υ are also illustrated in FIG. 1 as well as a first axis x (parallel to the horizontal plane and perpendicular to the median plane), a second axis y (parallel to the median plane and perpendicular to the horizontal plane), and a third axis z (parallel to the median plane and perpendicular to the frontal plane).

Figure 2A:
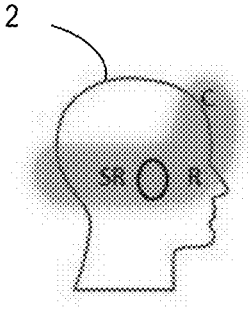
FIGS. 2A and 2B schematically illustrate a typical path of virtual sources positioned around a user's head.
Figure 2B:
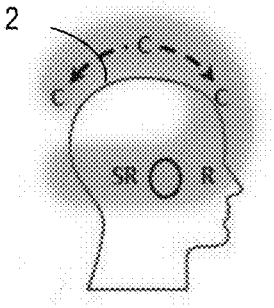

If sound in conventional headphone arrangements is externalized by suitable signal processing methods (externalizing in this context means that at least the predominant part of the sound image is perceived as being originated outside the user's head), the center channel image tends to move mainly upwards instead of to the front. This is exemplarily illustrated in FIG. 2A, wherein SR identifies the surround rear image location, R identifies the front right image location and C identifies the center channel image location. Virtual sound sources may, for example, be located somewhere on and travel along the path of possible source locations as is indicated in FIG. 2A if the azimuth angle φ (see FIG. 1) is incrementally shifted from 0° to 360° for binaural synthesis, based on generalized head related transfer functions (HRTF) from the horizontal plane. While especially binaural techniques based on HRTF filtering are very effective in externalizing the sound image and even positioning virtual sound sources on most positions around the user's head, such techniques usually fail to position sources correctly on a frontal part of the median plane. A further problem that may occur is the so-called front-back confusion, as is illustrated in FIG. 2B. Front-back confusion means that the user 2 is not able to locate the image reliably in the front of his head, but anywhere above or even behind his head. This means that neither the center sound image of conventional stereo systems nor the center channel sound image of common surround sound formats can be reproduced at the correct position when played over commercially available headphones, although those positions are the most important positions for stereo and surround sound presentation as well as for VR and AR applications.

Sound sources that are arranged on the median plane (azimuth angle φ=0°) lack interaural differences in time (ITD) and level (ILD) which could be used to position virtual sources. If a sound source is located on the median plane, the distance between the sound source and the ear as well as the shading of the ear through the head are the same to both the right ear and the left ear. Therefore, the time the sound needs to travel from the sound source to the right ear is the same as the time the sound needs to travel from the sound source to the left ear and the amplitude response alteration caused by the shading of the ear through parts of the head is also equal for both ears. The human auditory system analyzes cancellation and resonance magnification effects that are produced by the pinnae, referred to as pinna resonances in the following, to determine the elevation angle on the median plane. Each source elevation angle and each pinna generally provokes very specific and distinct pinna resonances.

Pinna resonances may be applied to a signal by means of filters derived from HRTF measurements. However, attempts to apply foreign (e.g., from another human individual), generalized (e.g., averaged over a representative group of individuals), or simplified HRTF filters usually fail to deliver a stable location of the source in the front, due to strong deviations between the individual pinnae. Only individual HRTF filters are usually able to generate stable frontal images on the median plane if applied in combination with individual headphone equalizing. However, such a degree of individualization of signal processing is almost impossible for the consumer mass market.

Figure 3:
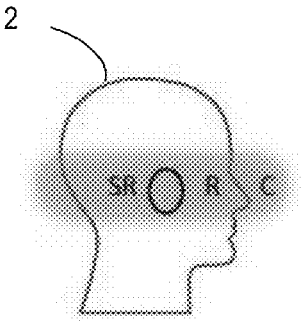
FIG. 3 schematically illustrates a possible path of virtual sources positioned around a user's head.

The present disclosure includes VR and AR headset arrangements that are capable of individually generating directional pinna cues associated with at least two approximately opposing directions. Some of the proposed headset arrangements support the generation of an improved centered frontal sound image and embodiments of the disclosure are further capable of positioning virtual sound sources all around the user's head 2 if combined with appropriate signal processing. This is exemplarily illustrated in FIG. 3, where the center channel image C is located at a desired position in front of the user's head 2. If directional pinna cues associated with the frontal and rear hemisphere are available and can be individually controlled, for example if they are produced by separate loudspeakers, it is possible to position virtual sources all around the user's head if, in addition, suitable signal processing is applied. Additionally, directional pinna cues from above and below the user 2 may be induced to improve the placement of the virtual sources in the respective hemisphere.

Figure 4A:
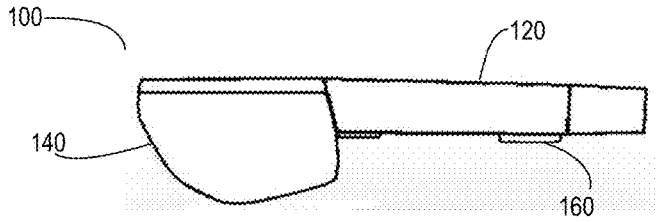
FIGS. 4A to 4C schematically illustrate virtual reality headset arrangements with integrated sound sources.

Some of the VR headsets available today provide integrated solutions for audio playback. One example of such a VR headset 100 is schematically illustrated in FIG. 4A. The headset 100 includes a support unit 120. The support unit 120 is generally configured to hold the headset 100 on the user's head. A display 140 is coupled to the support unit 120. The display 140 is arranged on the support unit 120 such that it is held in front of the user's eyes. The headset 100 of FIG. 4A is designed in the shape of eyeglasses. The support unit 120 is designed as a ring that surrounds the user's head and the display 140 is designed as eyeglass lenses. A sound source 160 is integrated into the support unit 120. As the earpieces 120 are arranged above the user's ears, the sound source 160 is arranged above the user's ears when the headset 100 is worn by the user. The sound, therefore, is provided from above the user's ears (main direction of sound propagation essentially perpendicular to the horizontal plane).

Figure 4B:
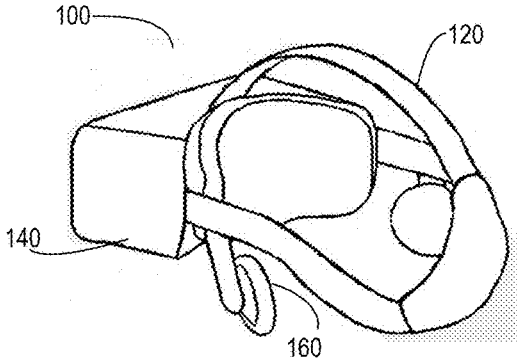

FIG. 4B schematically illustrates a further prior art example of a headset 100. In this example the support unit 120 includes several straps that are arranged such that the headset 100 is held on the user's head. For example, one strap may run along each side of the user's head above the ear and one strap may run along the top of the user's head. The straps may be joined at the back of the user's head. The display 140 may be coupled to the straps such that it is held in front of the user's eyes when the headset 100 is worn by the user. The sound sources 160 are designed as some kind of on-ear headphone that are placed on the ears of the user 2 when the headset 100 is worn by the user 2. The sound, therefore, is provided in the same way as in standard headphones. The on-ear headphones of the headset 100 in FIG. 4B block the ears from the acoustic environment and may put physical pressure on the ears which might me unpleasant for the user.

Figure 4C:
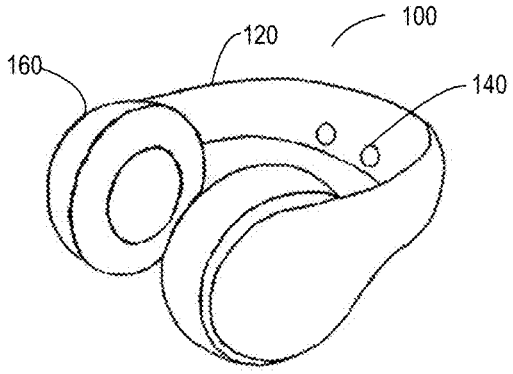

A third example of a prior art headset 100 is schematically illustrated in FIG. 4C. The sound sources 160 are designed as closed-back over the ear headphones. The support unit 120 includes some kind of headband which, however, is not worn over the head, but in front of the head. The display 140 is integrated in the support unit 120. When worn by the user, the headset 100 is held in place by the closed-back headphones arranged on the ears of the user 2 and by the headband which runs in front of the user's head and may rest on the user's nose, for example. The sound, therefore, is provided in the same way as in standard headphones. The arrangement, therefore, has similar drawbacks as standard headphones and as the arrangement of FIG. 4B. None of the headset arrangements 100 of FIGS. 4A to 4C is able to reliably place stable virtual sound sources directly in front of the user's head without additional signal processing, wherein the signal processing includes individual HRTF filters for the respective user.

Figure 5:
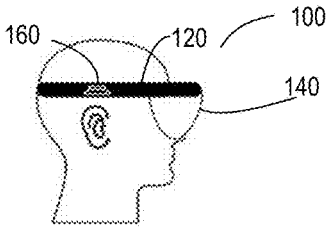
FIG. 5 schematically illustrates a further virtual reality headset arrangement.

FIG. 5 schematically illustrates a simplified version of the headset arrangement 100 of FIG. 4A. A sound source 160 is integrated into the support unit 120 and emits sound directly from above the user's ear. The sound source 160, therefore, is arranged in relative proximity of the user's ear, however, positioning a single sound source above the user's ear is detrimental for the generation of a frontal sound image because it induces a directional cue associated with directions above the user, which contradicts the desired directional perception in front of the user. This may generally be overcome by compensation filters that equalize the speaker to ear transfer function to be approximately equal over frequency.

Most VR headsets today, however, do not have any integrated audio sources, but have to be combined with standard headphones. The spatial characteristics of typical headphones are usually less important than general sound quality attributes such as tonal balance, a wide working frequency range and low distortion. If the general sound quality is inferior to typical headphone standards, spatial effects are usually rejected by users, especially for stereo playback. Embodiments of the proposed headset arrangement may not be substantially worse in general sound quality aspects than typical headphones that are available today. Especially the playback of low frequencies usually requires physical structures of considerable size to be positioned around the user's ear. The reduction of negative effects of such structures on the controlled induction of natural directional pinna cues is one aspect of the proposed headset arrangement. Controlled induction of natural directional pinna cues can serve multiple purposes. As has been described before, the localization accuracy of virtual sources on the median plane can be improved by inducing suitable directional pinna cues. Another advantage over conventional binaural synthesis based on generalized HRTFs is the improved tonality, because the user is presented with his own spectral shape cues which are, in contrast to foreign spectral shape cues, not perceived as disturbing tonality alterations. On the other hand, directional pinna cues may also be suppressed in a controlled way by superposition of multiple essentially contradicting directional cues as provided by the proposed headset arrangements. This provides an ideal basis for conventional binaural synthesis based on generalized or individual HRTFs, because no disturbing directional pinna cues are generated by the headset arrangement.

Conventional binaural synthesis that is based on generalized or individual HRTFs is currently the de facto standard for virtual and augmented reality applications which often only provide a binaural (2 channel) signal. Finally, even normal stereo playback without any spatial processing may benefit from headset arrangements that do not produce uncontrolled comb filtering effects which may result from reflections inside a headphone structure and disturb the tonality of reproduced sound. In some of the proposed headset arrangements, which include measures for reducing reflections within the headset structure, the natural sound field may reach the ear of the user virtually unaltered. Furthermore, the proposed headset arrangement solves problems of conventional headphones such as unwanted pressure on the ears or heat built up inside the ear cups, for example.

Within this document, the terms pinna cues and pinna resonances are used to denominate the frequency and phase response alterations imposed by the pinna and possibly also the ear canal in response to the direction of arrival of sound. The terms directional pinna cues and directional pinna resonances within this document have the same meaning as the terms pinna cues and pinna resonances, but are used to emphasize the directional aspect of the frequency and phase response alterations produced by the pinna. Furthermore, the terms natural pinna cues, natural directional pinna cues and natural pinna resonances are used to point out that these resonances are actually generated by the user's pinna in response to a sound field in contrast to signal processing that emulates the effects of the pinna. Generally, pinna resonances that carry distinct directional cues are excited if the pinna is subjected to a direct, approximately unidirectional sound field from the desired direction. This means that sound waves emanating from a source from a certain direction hit the pinna without the addition of very early reflected sounds of the same sound source from different directions. While humans are generally able to determine the direction of a sound source in the presence of typical early room reflections, reflections that arrive within a too short time window after the direct sound will alter the perceived sound direction. Therefore, some embodiments of the headset arrangement according to the present disclosure send direct sound to the pinna while suppressing, or at least reducing, reflections from surfaces close to the pinna and, therefore, are able to induce strong directional cues.

Known stereo headphones generally can be grouped into in-ear, over-ear and around-ear types. Around-ear types are commonly available as so-called closed-back headphones with a closed back-chamber behind the loudspeaker or as so-called open-back headphones with an open back-chamber behind the loudspeaker. Headphones may have a single or multiple drivers (loudspeakers). Besides high quality in-ear headphones, specific multi-way surround sound headphones exist that utilize multiple loudspeakers aiming on generation of directional effects.

In-ear headphones are generally not able to generate natural pinna cues, due to the fact that the sound does not pass the pinna at all and is directly emitted into the ear canal. Within a fairly large frequency range, on-ear and around-ear headphones having a closed back produce a pressure chamber around the ear that usually either completely avoids pinna resonances or at least alters them in an unnatural way. In addition, this pressure chamber is directly coupled to the ear canal which alters ear canal resonances as compared to an open sound-field, thereby further obscuring natural directional cues. At higher frequencies, elements of the ear cups reflect sound, whereby a diffuse sound field is produced that cannot induce pinna resonances associated with a single direction. The headset according to the present disclosure includes an open sound structure and, therefore, avoids such drawbacks.

Typical open-back headphones as well as most closed-back around-ear and on-ear headphones that are available on the market today utilize large diameter loudspeakers. Such large diameter loudspeakers are often almost as big as the pinna itself, thereby producing a large plane sound wave from the side of the head that is not appropriate to generate consistent pinna resonances as would result from a directional sound field from the front. Additionally, the relatively large size of such loudspeakers as compared to the pinna, as well as the close distance between the loudspeaker and the pinna and the large reflective surface of such loudspeakers result in an acoustic situation which resembles a pressure chamber for low to medium frequencies and a reflective environment for high frequencies. Both situations are detrimental to the induction of natural directional pinna cues associated with a single direction.

Surround sound headphones with multiple loudspeakers usually combine loudspeaker positions on the side of the pinna with a pressure chamber effect and reflective environments. Such headphones are usually not able to generate consistent directional pinna cues, especially not for the frontal hemisphere.

Generally all kinds of objects that cover the pinna, such as back covers of headphones or large loudspeakers themselves may cause multiple reflections within the chamber around the ear which generates a diffused sound field that is detrimental for natural pinna effects as caused by directional sound fields.

Therefore, the present disclosure provides an optimized headset arrangement that allows to send direct sound towards the pinna from all desired directions while minimizing reflections, in particular reflections from the headset arrangement itself into the region of the pinna or the concha of the user. While pinna resonances are widely accepted to be effective above frequencies of about 2 kHz, real world loudspeakers usually produce various kinds of noise and distortion that will allow the localization of the loudspeaker even for substantially lower frequencies. The user may also notice differences in distortion, temporal characteristics (e.g., decay time) and directivity between different speakers used within the frequency spectrum of the human voice. Therefore, a lower frequency limit in the order of about 200 Hz or lower may be chosen for the loudspeakers that are used to induce directional cues with natural pinna resonances, while reflections may be controlled at least for higher frequencies (e.g., above 2-4 kHz).

Generating a stable frontal image on the median plane presents the presumably highest challenge as compared to generating a stable image from other directions. Generally, the generation of individual directional pinna cues is more important for the frontal hemisphere (in front of the user) than for the rear hemisphere (behind the user). Effective natural directional pinna cues are easier to induce for the rear hemisphere for which the replacement with generalized cues is generally possible with good effects at least for standard headphones which place loudspeakers at the side of the pinna. Therefore, some of the proposed headset arrangements focus on optimization of frontal hemisphere cues while providing weaker, but still adequate, directional cues for the rear hemisphere. Other arrangements may provide equally good directional cues for each of the front and rear direction. To achieve strong natural directional pinna cues, the headset arrangements are configured such that the sound waves emanated by one or more sound sources mainly pass the pinna, or at least the concha, once from the desired direction with reduced energy in reflections that may occur from other directions. Some arrangements focus on the reduction of reflections for sound sources in the frontal part of the sound structure, while other arrangements minimize reflections independent from the position of the sound source. The sound structure of a VR or AR headset according to the present disclosure may comprise such parts of the headset, which contribute to the generation or control of sound. Such parts may, for example, comprise sound sources, waveguides, sound tubes, reflectors, and any support structure for any of these components. The sound structure may be partly or completely integrated into a larger support structure of the headset. The sound structure may encircle the ear of the user partly or completely. The present disclosure generally avoids putting the ear into a pressure chamber, at least above 2 kHz, and in some embodiments reduces reflections into the pinnae which tend to cause a diffuse sound field. To avoid reflections, the at least two sound sources may be positioned on the headset such that it results in the desired directions of the respective sound fields. The support structure is arranged such that reflections are avoided or minimized.

Most VR and AR headsets today include solid structures that are arranged almost all around the user's head to comfortably support the weight of the display that is arranged in front of the user's eyes. The display usually forms a mass center that is arranged at a comparably large distance in front of the user's head. In many cases such solid structures generally allow an integration of loudspeakers or, more generally speaking, sound sources. An integration of sound sources usually only causes a moderate increase of the external dimensions of the headset. In any case, most of the headset structures today are strong enough to carry additional sound sources. Most headset structures also allow to place the sound sources at clearly defined positions with respect to the user's ears. Some headset structures already offer an advantageous design that allows to place the sound sources at positions which are advantageous for generation of natural directional pinna cues associated with the preferred directions for improvement of virtual sound source positioning (e.g., front and back). Furthermore, an uneven mass distribution caused by the display arranged at the front of the headset structure allows for the addition of a certain weight along the middle and rear parts of the headset structure.

Therefore, according to some embodiments of the present disclosure, loudspeakers or sound sources are integrated into headset structures that are similar to known VR headset designs. These embodiments illustrate the principles of sound source integration into VR headsets, although sound sources generally may be integrated into any VR headset design. Generally, loudspeakers may be arranged anywhere on the headset structure. In some examples, the loudspeakers radiate sound directly in a desired direction. In other examples, however, one or more loudspeakers radiate sound into a sound control unit such as a sound canal, sound tube, wave guide, reflector or the like. The sound control unit may be configured to control the direction of the sound field that arrives at the ear of the user or, in particular at the pinna of the user's ear. For example, a loudspeaker may be arranged at a first end of a sound canal and the sound outlet at the other end of this sound canal may be arranged such that sound is emitted in a desired direction and/or from a desired position with respect to the pinna when exiting the sound canal. The respective loudspeakers, however, do not necessarily have to be arranged in proximity to the user's ear and/or emit sound in a desired direction. For example, a loudspeaker may be arranged within a sound canal, sound tube or wave guide of which separate sections attach to the front and respectively back of the loudspeaker, guiding sound from one side of the loudspeaker towards a pinna of the user while guiding sound from the other side of the loudspeaker away from the pinna or towards the second pinna. The Figures exemplarily illustrate loudspeakers and loudspeaker arrangements. However, it should be noted that the loudspeakers illustrated in the Figures merely represent sound sources, e.g., sound outlets of sound control units, and the sound may be generated at different locations within the headset structure. In those examples where the loudspeakers are arranged at or close to the positions illustrated in the Figures, they should not necessarily be understood as a single loudspeaker. One of the exemplarily illustrated sound sources may include more than one loudspeaker or more than one other sound generating device. In any case, it may be assumed that sound sources direct at least a part of their radiated sound towards the pinna. Furthermore, most of the Figures illustrate a headset structure only for the right side of a user's head. It should be noted that the same applies for the other ear (e.g., left ear) which is not illustrated in the Figures.

Figure 6:
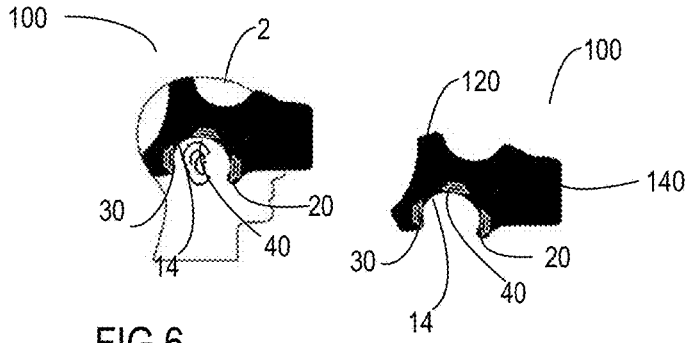
FIG. 6 schematically illustrates a virtual reality headset arrangement and possible positions of sound sources with respect to the user's ear.

One example of a headset 100 is illustrated in FIG. 6. The headset 100 includes a support unit 120. A display 140 may be integrated into the support unit 120. The display 140, however, may be a separate display 140 that may be separably mounted to the support unit 120. The support unit 120 forms at least one sound structure 14. The sound structure 14 comprises a frame that is configured to form an open structure around the ear. The frame of the sound structure 14 may be arranged to partly or entirely encircle the ear of the user 2. In the example of FIG. 6, the frame only partly encircles the user's ear, e.g., half of the ear. This is, however, only an example. In other examples, the frame may encircle the ear to a higher (e.g., completely) or a lesser extent (e.g., a quarter of the ear or even less). The frame may be a continuous frame that partly or completely encircles the ear in one continuous piece and without any breaks, or it may be a broken frame, meaning that it includes at least one break within its circumference. The frame may define an open volume about the ear of the user 2, when the headset is worn by the user 2. In particular, the open volume may be essentially open to a side that faces away from the head of the user 2. The support unit 120 is configured to hold the sound structure 14 in place about the ear of the user 2. At least two sound sources 20, 30, 40 are arranged along the frame of the sound structure 14. For example, one front sound source 20 may be arranged at the front of the user's ear, one rear sound source 30 may be arranged behind the user's ear and one top sound source 40 may be arranged above the user's ear.

The frame of the sound structure 14 may be at least partially hollow inside. One or more walls may separate one or more cavities inside the frame from the surrounding air on the outside. At least one of the sound sources 20, 30, 40 may be a loudspeaker, wherein a first side of the loudspeaker faces the outside and a second side of the loudspeaker faces one of the at least one cavities inside the frame. In this way the one or more cavities provide a back volume for at least one loudspeaker. The at least two sound sources 20, 30, 40 are configured to emit sound to the ear from a desired direction (e.g., from the front, rear or top). One of the at least two sound sources 20, 30, 40 may be positioned on the frontal half of the sound structure 14 to support the induction of natural directional cues as associated with the frontal hemisphere. At least one sound source 30 may be arranged behind the ear on the rear half of the sound structure 14 to support the induction of natural directional cues as associated with the rear hemisphere. When arranging the at least one sound source 20 on the frontal half of the sound structure 14, the sound source position with respect to the horizontal plane through the ear canal does not necessarily have to match the elevation angle $\upsilon$ of the resulting sound image. An optional sound source 40 above the user's ear, or user's pinna, may improve sound source locations above the user 2.

Figure 7:
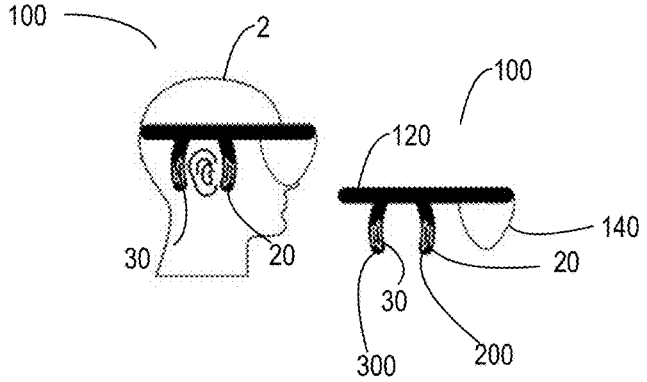
FIG. 7 schematically illustrates a further virtual reality headset arrangement and possible positions of sound sources with respect to the user's ear.

FIG. 7 illustrates a further example of a headset 100. Whereas the support structure 120 illustrated in FIG. 6 is a comparably large structure with a comparably large surface area which covers the user's head to a large extent, the support structure 120 of FIG. 7 resembles eyeglasses with an a ring-shaped structure 120 that is arranged around the user's head and a display 140 that is held in position in front of the user's eyes. The frame of the sound structure 14 may include extensions 200, 300 that are coupled to the support structure 120, wherein a first extension 200 extends from the ring-shaped support structure in front of the user's ear and a second extension 300 extends from the ring-shaped support structure behind the user's ear. A section of the ring-shaped support structure may form a top part of the frame. One sound source 20 may be arranged in the first extension 200 to provide sound to the user's ear from the front. A second sound source 30 may be arranged in the second extension 300 to provide sound to the user's ear from the rear. The headset 100 in FIG. 7 does not include a top sound source that is arranged to emit sound from above the user's ear. However, such a top sound source may optionally be included into the headset 100 of FIG. 7. Further, the sound sources 30, 40 that are arranged in the extensions 200, 300 may be sound outlets of a sound control unit that may extend into the support structure 120 and may be acoustically coupled to at least one loudspeaker to provide a sound input into the sound control unit.

Figures 8A, 8B, 8C:
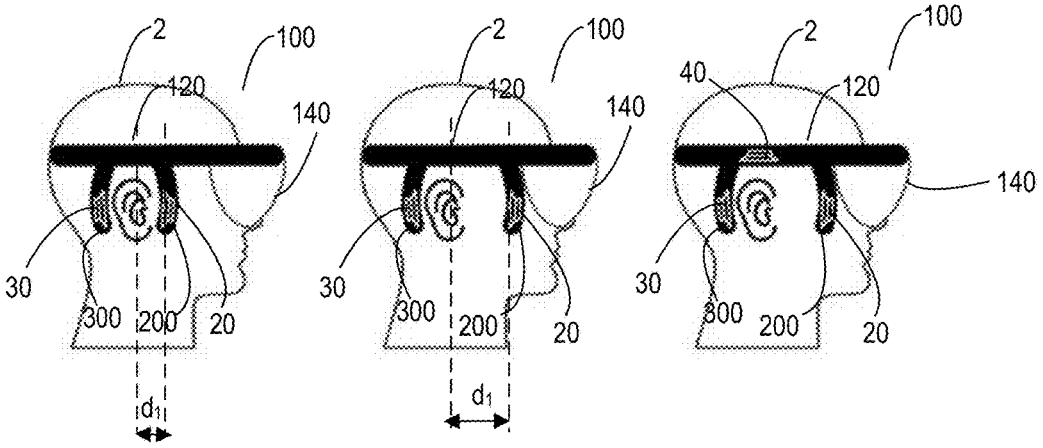
FIGS. 8A to 8C schematically illustrate a further example of a virtual reality headset arrangement and possible positions of sound sources with respect to the user's ear.

FIGS. 8A to 8C illustrate a further example of a headset 100. The arrangement illustrated in FIG. 8A is equivalent to the arrangement of FIG. 7. As can be seen, the first extension 200 and, therefore, the first sound source 20 is arranged relatively close to the user's pinna and emits sound essentially parallel to the horizontal plane (main direction of sound propagation essentially parallel to the horizontal plane). The first sound source 20 is arranged at a first distance $d_1$ in front of the user's pinna. In one example, the first distance $d_1$ may be shorter than 3 cm or shorter than 5 cm. As is illustrated in FIG. 8B, the first sound source 20 in front of the user's ear may be moved further away from the pinna. In one example, the first distance $d_1$ may be shorter than 8 cm or shorter than 10 cm, for example. This means that the first sound source 20 may be arranged essentially at ear height anywhere along the support structure 120 between the display 140 and the pinna. For example, the first sound source 20 may be arranged essentially at ear height at the level of the user's cheek or at the level of the user's eye. In the example illustrated in FIG. 8C, an additional third sound source 40 is arranged above the user's ear. The third sound source 40 above the user's ear mainly supports the generation of virtual sound sources above the user, while the first sound source 20 and the second sound source 30 support virtual sound source generation in front or behind the user 2. If combined with suitable signal processing, the first sound source 20 and the second sound source 30 may support the generation of sound sources in the entire horizontal plane or even all around the user. The third sound source 40 above the user's ear may additionally or exclusively support the low frequency range, e.g., frequencies below 2 kHz or frequencies below 100 Hz.

Figure 9:
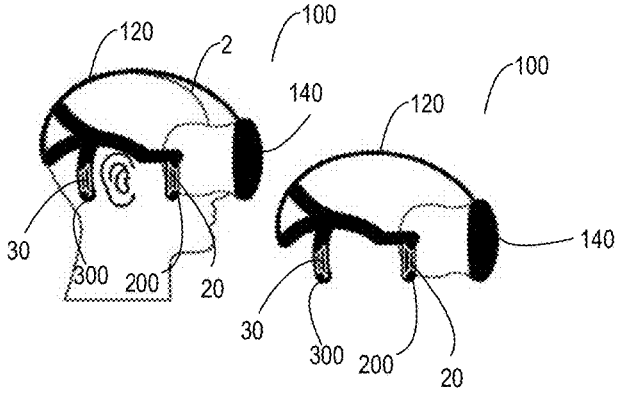
FIG. 9 schematically illustrates a further example of a virtual reality headset arrangement and possible positions of sound sources with respect to the user's ear.

A similar arrangement is illustrated by means of FIG. 9. The support structure 120 is similar to the support structure that has been described referring to FIG. 4B. When worn by the user 2, first and second straps are arranged at the sides of the user's head above the user's ears. A third strap runs on the top of the user's head from the front of the support structure 120 to the back. At the back of the user's head, the first, second and third straps are interconnected. The support structure 120 in FIG. 9 includes a first extension 200 and a second extension 300. The first extension 200 and the second extension 300 together with a part of the support structure form the sound structure of the headset arrangement 100. As has been described referring to FIG. 7 above, the first extension 200 extends from the support structure 120 in front of the user's ear and the second extension extends 300 from the support structure 120 behind the user's ear. A first sound source 20 is arranged on the first extension 200 to emit sound from the front of the user's ear and a second sound source 30 is arranged on the second extension 300 to emit sound from behind the user's ear. The first extension 200 may be arranged at the level of the user's cheek or at the level of the user's eye, for example. The position of the first extension 200 may be defined by the position of the display 140 or a display holder of the support structure 120, for example.

Figure 10A:
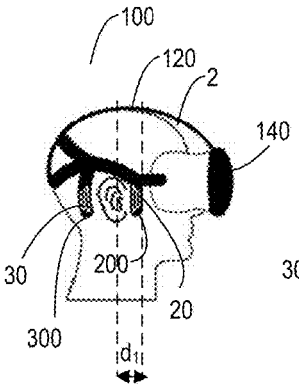
FIGS. 10A to 10D schematically illustrate a further example of a virtual reality headset arrangement and possible positions of sound sources with respect to the user's ear.
Figure 10B:
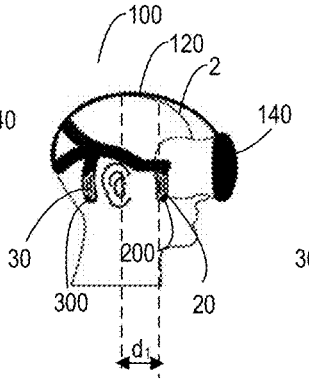
Figure 10C:
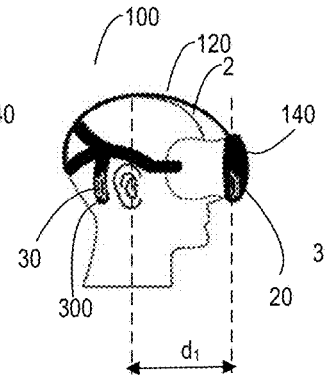
Figure 10D:
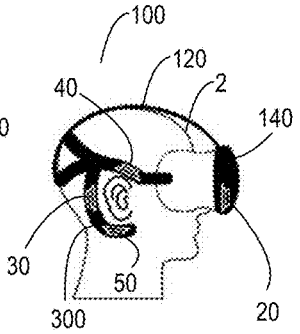

As is illustrated in FIG. 10A, the first extension 200 may be arranged almost directly in front of the user's ear. This means that the first distance $d_1$ between the ear canal and the first extension 200 is rather short. For example, the first distance $d_1$ may be shorter than 3 cm or shorter than 5 cm. However, as has been described by means of FIGS. 8B, 8C and 9 before and as is illustrated in FIG. 10B, the first distance $d_1$ may be shorter than 8 cm or shorter than 10 cm, for example. As is illustrated by means of FIG. 10C, the first extension 200 may be omitted. Instead of arranging the first sound source 20 on a first extension 200, it may be arranged somewhere on the display 140, for example. In this way, the first sound source 20 may be arranged essentially at ear level at the level of the user's nose or even in front of the user's head, for example. The first distance $d_1$ may be greater than 8 cm or greater than 10 cm, for example.

A third sound source 40 may be arranged on the support structure 120 essentially above the user's ear. The main direction of sound propagation of the third sound source 40 may be directed essentially towards the user's ear canal. However, the main direction of sound propagation of the third sound source 40 does not necessarily have to be perpendicular to the horizontal plane (sound source 40 arranged directly above the ear canal of the user 2). The third sound source 40 may be arranged such that its main direction of sound propagation is at an angle between about 45° and about 90°, between about 60° and 90° or between 75° and 90° with respect to the horizontal plane.

The second extension 300 may be an essentially straight extension passing behind the user's ear. This is, however, only an example. The second extension 300 may include an appendix which passes below the user's ear. In one example, the second extension 300 is essentially L-shaped. A fourth sound source 50 may be arranged on the appendix of the second extension 300 such that it emits sound from essentially below the user's ear (main direction of sound propagation perpendicular to the horizontal plane from below). It is also possible that the first extension 200 is an essentially L-shaped extension and includes a sound source which emits sound from essentially below the user's ear, for example.

Figure 11:
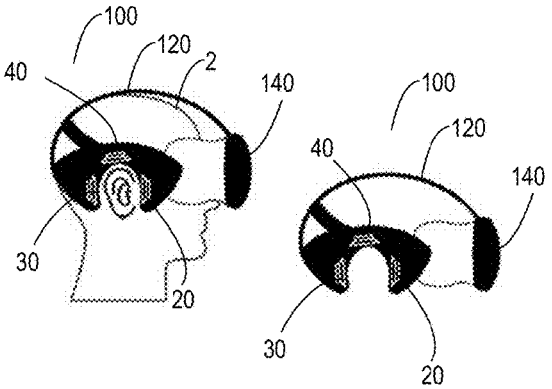
FIG. 11 schematically illustrates a further example of a virtual reality headset arrangement and possible positions of sound sources with respect to the user's ear.

Referring to FIG. 11, a similar headset 100 is illustrated. The headset 100 includes a support structure 120, a display 140 and first, second and third sound sources 20, 30, 40 that are configured to emit sound from the front, the rear and from above the user's ear. The support structure 120 is somewhat different to the support structures 120 illustrated in FIGS. 6 to 10. The shape of the support structure 120 is such that no extensions are needed for arranging sound sources around the user's ear. The support structure 120 itself forms a sound structure at least partially around the user's ear, or, in other words, the sound structure is integrated into the support structure 120.

Figure 12:
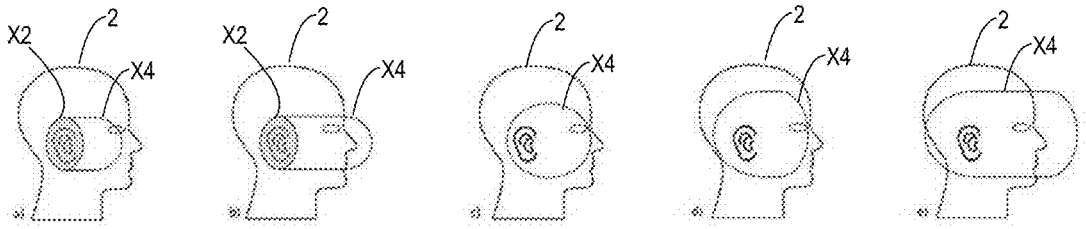
FIG. 12 schematically illustrates possible regions for sound source arrangement.

Generally, sound sources that are arranged essentially at ear level in front of the user's ear are suited particularly well for generating virtual sound sources in front of the user 2. However, there is a wide range of locations at which sound sources may be positioned around the ear or, in particular, around the pinna of the user 2. As has already been described above, the term "sound source" as used herein, may refer to a loudspeaker or to a sound outlet of a sound control unit which directs sound of a remote loudspeaker or any other remote sound generation unit in a desired direction. The general principle of the present disclosure is described in more detail referring to FIG. 12. Examples a) and b) of FIG. 12 illustrate an essentially oval shape about the ear of the user 2. The essentially oval shape is illustrated as a shaded area in examples a) and b). The oval shape about the user's ear represents a first region X2 which may be preferred for sound sources that are configured for low frequency playback, e.g., below 100-200 Hz, according to one example. The first region X2 represented by the oval shape may also be an important region for the generation of natural directional pinna cues, e.g., above 2 kHz. It should be noted that the distance between a low frequency sound source and the user's pinna is generally uncritical, as long as such sound sources do not interact with other sound sources that are used for the stimulation of pinna resonances (e.g., cause detrimental reflections). Due to the close proximity of the ear canal, typical sound pressure levels (SPL) for listening are not required for the far field of the associated sound source, which reduces the requirements concerning a maximum possible SPL of the sound source. It should be noted that the near field SPL requirements are extended towards the position of a sound outlet if a loudspeaker associated with a sound source emits sound into a canal, tube or waveguide whose sound outlet is arranged close to the ear canal of the user 2. This is exemplarily illustrated in FIG. 19B. The headset arrangement 100 in FIG. 19B comprises a sound canal 60. One or more third sound sources 40 may be arranged on the support structure 120 such that they emit sound into the sound canal 60. The sound canal comprises an outlet. The outlet faces in the direction of the open volume around the user's ear. Therefore, sound that is generated by at least one loudspeaker is emitted into the sound canal 60 and exits the sound canal 60 through the outlet into the open volume around the user's ear. The one or more loudspeakers together with the sound canal 60 form the third sound source 40. For example, sound sources that are configured for low frequency playback, e.g., below 100-200 Hz, which may therefore have a larger physical size than loudspeakers for frequencies above 100-200 Hz, may be placed further away from the ear canal to allow a better integration into predetermined or generally desired structures of VR or AR headsets.

Figure 19A:
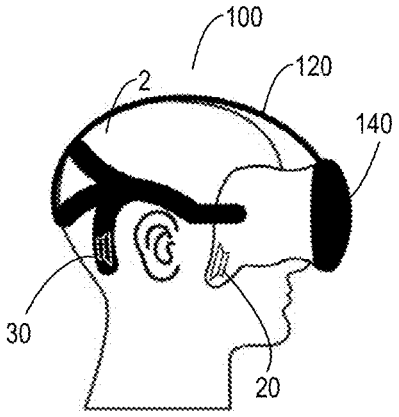
FIGS. 19A and 19B schematically illustrate a further example of a virtual reality headset arrangement and possible positions of sound sources with respect to the user's ear.
Figure 19B:
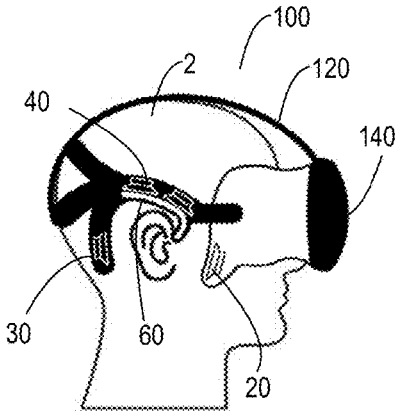

The examples of FIGS. 19A and 19B are similar to the examples that are illustrated in FIGS. 10A to 10D. The support structure 120 is similarly attached to the user's head as compared to the support structure in FIGS. 10A to 10D. The frame of the sound structure 140 in FIGS. 19A and 19B, however, includes only one extension coupled to the support structure 120. This extension extends from the support structure 120 behind the user's ear. The sound structure 140 in FIGS. 19A and 19B does not include a second extension which extends from the support structure 120 in front of the user's ear. A first sound source 20 that is arranged in front of the user's ear to emit sound from the front may be coupled to the display 140, for example. The display 140 is generally held in front of the user's eyes by a kind of display support structure which may further shield the user's eyes from the surroundings and any disturbing lights, for example. A sound source 20 may, for example, be arranged on or integrated into such a display support structure. FIG. 19A illustrates an example that includes sound sources 20, 30 only at the front and behind the user's ear. The example in FIG. 19B further includes a sound source 40 above the user's ear that includes loudspeakers which emit sound into a sound canal 60, as has been described above. The outlet of the sound canal 60 may be arranged such that sound emitted from the third sound source 40 reaches the user's ear from above, from the front or any direction in between.

Examples a) and b) of FIG. 12 also illustrate a second region X4. The second region X4 represents a region in which sound sources may be arranged remote from the first region X2. Such remote positions are often available for sound source integration in many VR headsets. Sound source positions within the second region X4 are often very well suited for the purpose of controlled stimulation of natural directional pinna cues. Generally, the second region X4 may at least partly overlap with the side profile of a user's head, as is illustrated in FIG. 12. It is, however, possible that parts of the second region X4 extend beyond the side profile of the user's head in a frontal direction, as is illustrated in examples b) and e), for example. If a sound source is arranged comparatively close to the user's pinna, direct sound reaches the respective ear on that side of the user's head at which the sound source is located. Direct sound to the other side of the user's head, however, may be blocked by the user's head. If a sound source is arranged comparatively far away from the user's pinna, as illustrated in examples b) and e) of FIG. 12, for example, direct sound reaches the respective ear on that side of the user's head at which the sound source is located. Direct sound to the other side of the user's head, however, may be blocked by the support structure or the display in front of the user's head. Examples c) and d) of FIG. 12 illustrate further shapes of the second region X4 within which the sound sources may be arranged.

For natural pinna resonance stimulation above about 2 kHz a sound source that is arranged approximately in front of the pinna can be used to improve stability and accuracy of virtual sound sources in front of the user. A definition of directions with respect to the pinna, e.g., front, rear, left, right, is given by means of FIG. 17 further below. If virtual sound sources are only required in the frontal hemisphere, a single sound source in front of the pinna may be sufficient. However, this is usually not the case for VR or AR applications. Similarly, a single sound source behind the pinna may be sufficient if only virtual sound sources from the back are needed. Single sound sources above or below the pinna are similarly restricted in the supported field of possible virtual source positions. The further the sound source position moves towards the side of the pinna, the less pronounced are the directional cues from the pinna and the less restriction applies to the field of possible virtual source positions. If a single sound source is arranged on the side of the pinna (position designated with "S" in FIG. 17), this situation resembles that of a conventional open-back headphone for which virtual sound sources in front of the user are very complex to generate. In all cases that require full 2D or 3D audio support, the headset arrangement may comprise a first sound source and a second sound source, wherein the first sound source is configured to generate directional pinna cues in form of natural pinna resonances and the second sound source is configured to provide pinna resonances that are associated with a direction that essentially opposes the direction associated with the pinna resonances generated by the first sound source. Strong natural directional pinna cues especially from the median plane usually cannot be reliably outweighed by binaural signal processing, unless the transfer function from the sound source producing the natural pinna cues to the input of the respective ear canal is compensated. This results in the already mentioned problem of unknown individual pinna resonances.

Therefore, the proposed headset aims at essentially neutralizing natural directional cues in form of pinna resonances for those cases in which the desired virtual sound source direction does not match the available directional cue from any individual or combined sound sources. Therefore, sound fields from opposing directions are superimposed in the area of the pinna. This requires respective sound sources arranged at largely opposing directions with respect to the pinna or concha region. If a sound source is arranged in front of the pinna, another sound source behind the pinna may be added to complement the sound source in front of the pinna with a sound field from an opposing direction. This is exemplarily illustrated in FIG. 13. In example a) of FIG. 13, a first sound source 21 is arranged in front of the user's pinna or concha. A relevant direction of sound propagation of the first sound source 21 in example a) is essentially parallel to the horizontal plane. A second sound source 22 is arranged behind the user's pinna or concha. A relevant direction of sound propagation of the second sound source 22 is also essentially parallel to the horizontal plane, but in an opposing direction as compared to the main direction of sound propagation of the first sound source 21. The relevant direction of sound propagation of a sound source is the direction of sound emitted by the respective sound source towards the ear canal of the user. The relevant direction of sound propagation of a sound source is a result of the position of the sound source relative to the concha of the user 2. It is not a feature of the sound source alone. The relevant direction of sound propagation may coincide with the direction of the main radiation lobe of the loudspeaker if the loudspeaker is oriented with its main radiation lobe pointed towards the concha of the user 2. If, however, the main radiation lobe is not angled towards the concha, the direction of the main radiation lobe does not equal the relevant direction of sound propagation. The relevant direction of sound propagation is illustrated by means of arrows in examples a) and b) of FIG. 13. In the example a) of FIG. 13, a resulting angle between the relevant directions of sound propagation of the two sound sources 21, 22 is 180°. However, the term "essentially opposing" may also refer to angles of 180°±5°, 180°±10°, 180°±15°, 180°±20°, 180°±30°, 180°±40°, 180°±50° or 180°±90°, for example.

Figure 13:
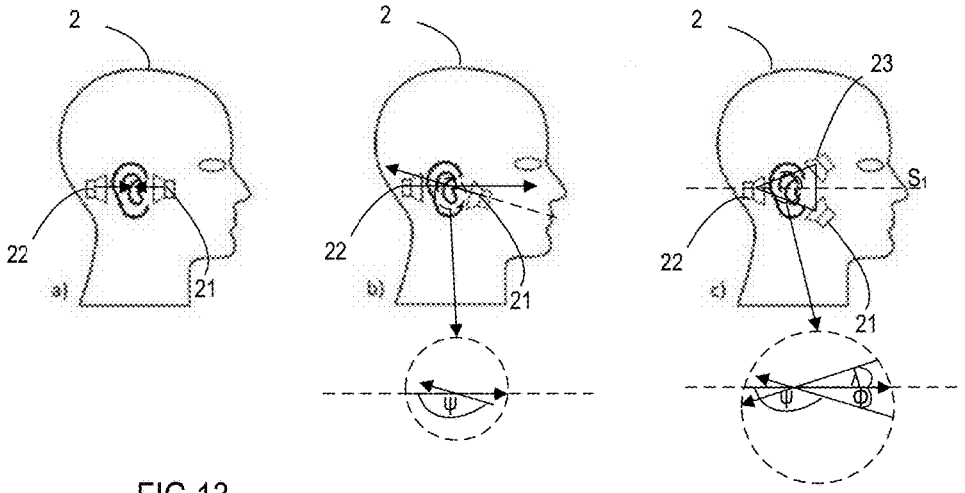
FIG. 13 schematically illustrates examples of sound source positioning with respect to the user's ear.
Figure 14A:
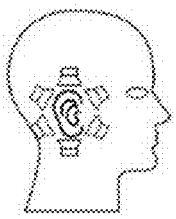
FIGS. 14A to 14D schematically illustrate further examples of sound source positioning with respect to the user's ear.
Figure 14B:
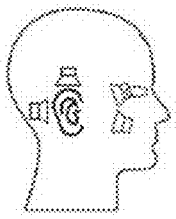
Figure 14C:
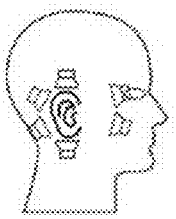
Figure 14D:
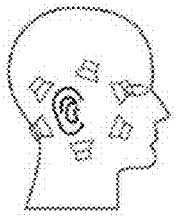

In example b) of FIG. 13 the relevant direction of sound propagation of the second sound source 22 is essentially the same as in example a) (parallel to the horizontal plane). The first sound source 21, however, is arranged at an angle below the horizontal plane. The first sound source 21 as well as its relevant direction of sound propagation are directed in an upwards direction towards the horizontal plane (indicated with an arrow), in particular towards the concha of the user. An angle Ψ between the relevant direction of sound propagation of the first sound source 21 and the relevant direction of sound propagation of the second sound source 22 may be between about 170° and about 180°, between about 150° and about 180°, between about 140° and about 180° or between about 130° and about 180°. Any other angle between 90° and 180° is also possible. The first sound source 21 and the second sound source 22 may emit the same signal towards the concha area, at least for frequencies between about 4 and about 15 kHz. A section around the ear canal in the example b) of FIG. 13 is illustrated in an enlarged manner below the figure to more clearly illustrate the angle Ψ between the relevant direction of sound propagation of the first sound source 21 and the relevant direction of sound propagation of the second sound source 22. In this example the relevant direction of sound propagation of the second sound source 22 falls onto the horizontal plane. In one example, the angle Φ between the relevant direction of sound propagation of the first sound source 21 and the horizontal plane may be between 10° and 50°. In other examples, different angles are possible. The relevant direction of sound propagation of the first sound source 21 and the horizontal plane may intersect within the concha of the user's ear. The first sound source 21 may be arranged below the horizontal plane and the relevant direction of sound propagation of the first sound source 21 may be directed towards the horizontal plane from below.

Instead of arranging a first sound source 21 in front of the user's pinna or concha and a second sound source 22 behind the user's pinna or concha, it is also possible, for example, to arrange one sound source above the user's pinna or concha and one sound source below the user's pinna or concha. In the second case, the relevant directions of sound propagation of the sound sources are essentially perpendicular to the horizontal plane. These are, however, only examples. Any other angles between the relevant direction of sound propagation of a sound source and the horizontal plane are possible, the relevant directions of the sound sources being essentially opposing with respect to the sound radiated towards the pinna or concha area. Possible angles Ψ between the relevant directions of sound propagations of two essentially opposing sound sources have already been described above with respect to examples a) and b) of FIG. 13. Any number of additional sound sources may be added to the opposing first and second sound sources. Additional sound sources may or may not complement the first or second sound source from an opposing direction. If, for example, a pair of complementing sound sources above and below the pinna is utilized, one additional sound source in front of the pinna may be sufficient, even if virtual sound sources behind the user are required. Virtual sound sources behind the user generally may be reliably generated by appropriate signal processing, if sound fields that are essentially free of clear natural directional cues can be applied to the respective ear.

Example c) of FIG. 13 schematically illustrates a further example of sound source positioning. The arrangement in example c) of FIG. 13 comprises a first sound source 21 and a second sound source 22 as has already been described with respect to example b) of FIG. 13. The arrangement may further comprise a third sound source 23. The third sound source 23 may be arranged above the horizontal plane. An angle λ between the relevant direction of sound propagation of the third sound source 23 and the horizontal plane may be between 10° and 50°. In other examples, different angles are possible. The relevant direction of sound propagation of the third sound source 23 and the horizontal plane may intersect at the concha of the user's ear. The third sound source 23 may be arranged above the horizontal plane and the relevant direction of sound propagation of the third sound source 23 may be directed towards the horizontal plane from above. In the enlarged section of example c), a further angle Φ is illustrated between the relevant direction of sound propagation of the first sound source 21 and the horizontal plane. The horizontal plane is illustrated in a dashed line.

The three sound sources 21, 22, 23 may be arranged at the corners of an isosceles triangle, wherein the symmetry axis $S_1$ of the triangle runs across the pinna or concha, or the ear canal. In example c), the second sound source 22 is arranged behind the pinna such that its relevant direction of sound propagation is essentially parallel to the horizontal plane. The first and third sound sources 21, 23 are arranged in front of the pinna, with the first sound source 21 being arranged below the horizontal plane and the third sound source 23 arranged above the horizontal plane. The relevant directions of sound propagation of the first and third sound sources 21, 23 arranged in front of the pinna are directed upwards or downwards, respectively, towards the horizontal plane and, in particular, towards the concha. The symmetry axis $S_1$ in example c) is essentially parallel to the horizontal plane. This is, however, only an example. The symmetry axis $S_1$ may be arranged at any angle with regard to the horizontal plane. In order to provide a signal to the user that is essentially neutral with regard to directional pinna cues induced at the user's ear, the first sound source 21, the second sound source 22 and the third sound source 23 may emit the same signal towards the concha of the user's ear, at least for frequencies between about 4 and about 15 kHz, whereas the signal level of the first sound source 21 and the third sound source 23 may be reduced by approximately 6 dB as compared to the signal of the second sound source 22, because the total SPL of the first and third sound source 21, 23 adds up and, therefore, needs to be reduced for an equal weighting of frontal and rear directional pinna cues as induced by the frontal and rear sound sources, respectively.

FIGS. 14, 15 and 16 schematically illustrate further examples of sound source positioning. Sound sources, generally, may be positioned all around the pinna, with two or more pairs of sound sources opposing each other, as is illustrated in FIG. 14A. In another example, three sound sources may be arranged at the corners of an isosceles triangle, as has been described with respect to FIG. 13 before, and further sound sources may be added in different locations around the pinna, as is illustrated in FIG. 14B. Sound sources may be arranged comparably close to the pinna or at a comparably large distance from the pinna, e.g., at the height of the user's cheeks or eyes. FIG. 14C illustrates opposing sound sources above and below the user's pinna and further sound sources in front and behind the user's pinna. The example illustrated in FIG. 14D also comprises pairs of opposing sound sources as well as additional sound sources without an opposing counterpart. The examples illustrated in FIGS. 15A to 15D and 16A to 16D also each comprise at least one pair of essentially opposing sound sources, with or without additional sound sources arranged at any location around the user's pinna.

Figure 15A:
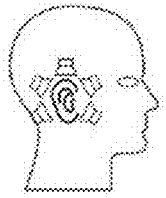
FIGS. 15A to 15D schematically illustrate further examples of sound source positioning with respect to the user's ear.
Figure 15B:
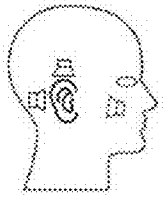
Figure 15C:
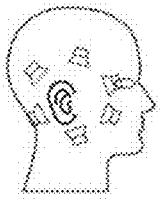
Figure 15D:
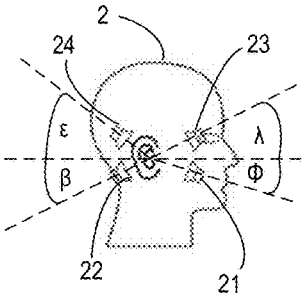
Figure 16A:
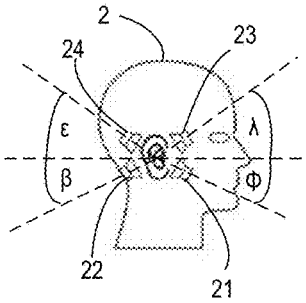
FIGS. 16A to 16D schematically illustrate further examples of sound source positioning with respect to the user's ear.
Figure 16B:
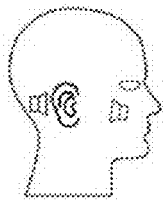
Figure 16C:
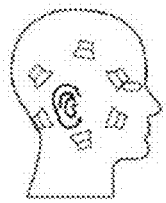
Figure 16D:
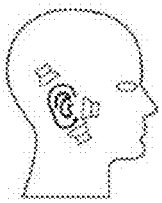

FIGS. 15D and 16A, for example, schematically illustrate further examples of sound source positioning. The arrangements in FIGS. 15D and 16A each comprise a first sound source 21, a second sound source 22 and a third sound source 23. The positions of the first and third sound source 21, 23 and their relevant directions of sound propagation have already been described with respect to example c) of FIG. 13. The second sound source 22 in the examples of FIGS. 15D and 16A, however, is arranged below the horizontal plane. An angle β between the relevant direction of sound propagation of the second sound source 22 and the horizontal plane may be between 10° and 50°. In other examples, different angles are possible. The relevant direction of sound propagation of the second sound source 22 and the horizontal plane may intersect at the concha of the user's ear. The second sound source 22 may be arranged below the horizontal plane and the relevant direction of sound propagation of the second sound source 22 may be directed towards the horizontal plane from below. The arrangements may further comprise a fourth sound source 24. The fourth sound source 24 may be arranged above the horizontal plane. An angle β between the relevant direction of sound propagation of the fourth sound source 24 and the horizontal plane may be between 10° and 50°. In other examples, different angles are possible. The relevant direction of sound propagation of the fourth sound source 24 and the horizontal plane may intersect at the concha of the user's ear. The fourth sound source 24 may be arranged above the horizontal plane and the relevant direction of sound propagation of the fourth sound source 24 may be directed towards the horizontal plane from above. The example in FIG. 15D differs from the example in FIG. 16A in that the first and third sound sources 21, 23 are arranged further away from the ear and, therefore, also the pinna and concha.

Other arrangement, such as the arrangements that are illustrated by means of FIGS. 14A, 14C, 14D, 15A, 15C and 16C, for example, are similar to the arrangements of FIGS. 15D and 16A but include even more than the four sound sources. Further sound sources may be arranged above or below the user's ear, for example.

Figure 17:
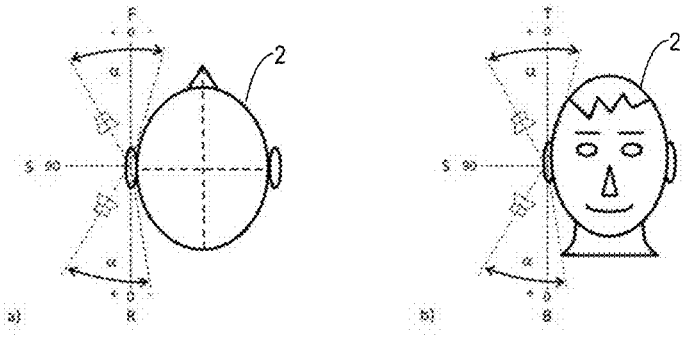
FIG. 17 schematically illustrates possible positions of sound sources with respect to the user's ear.

FIG. 17 schematically illustrates different sound source locations or sound directions with respect to the user's ear. A sound source that is arranged in front of the user's ear (or pinna/concha), frontal direction F, is arranged in front of the frontal plane (also called coronal plane) which equally divides anterior aspects and posterior aspects of the user's head and which lies at right angles to both the horizontal plane and the median plane (see FIG. 1). A frontal sound source may be arranged on a plane which runs through the user's ear and which is essentially parallel to the median plane (also called midsagittal plane) which is perpendicular to the ground surface and which crosses the user's head midway between the user's ears, thereby dividing the head in a left side and a right side. The relevant direction of sound propagation towards the concha from a sound source that is arranged on this plane (running through the user's ear parallel to the median plane) is essentially parallel to the median plane and essentially perpendicular to the frontal plane. It is, however, also possible, that a frontal sound source is not arranged on this plane (running through the user's ear essentially parallel to the median plane). A frontal sound source may be shifted with respect to such a plane such that its relevant direction of sound propagation towards the concha is at an angle α with respect to the median plane. The relevant direction of sound propagation from the sound source to the concha may be directed towards or away from the median plane. In any case, depending on the orientation and the position of the sound source with respect to the concha, the relevant direction of sound propagation of the respective sound source may or may not be identical with the direction of sound propagating towards the pinna/concha.

The same applies for a rear sound source which is arranged behind the frontal plane, rear direction R. A top sound source is arranged above the horizontal plane, which divides the user's head in an upper part and a lower part, top direction T, and a bottom sound source is arranged below the horizontal plane, bottom direction B. Top and bottom sound sources may be arranged on a plane which runs essentially parallel to the median plane such that their relevant direction of sound propagation towards the concha is essentially parallel to the median plane. It is, however, also possible that top and bottom sound sources are arranged such that their relevant direction of sound propagation towards the concha is at an angle α with respect to the median plane. The relevant direction of sound propagation towards the concha may be directed towards or away from the median plane. A sound source that is arranged on the side of the user's head, side direction S, may be arranged on the horizontal plane such that its relevant direction of sound propagation towards the concha is essentially parallel to the horizontal plane and the frontal plane and essentially perpendicular to the median plane.

Besides the above mentioned directions (front direction F, rear direction R, top direction T and bottom direction B), sound sources may be placed all around the ear with an angle $\alpha$ between their respective relevant direction of sound propagation towards the concha and a plane through the ear parallel to the median plane. Generally there are no restrictions for the angle $\alpha$. However, it should be considered that especially virtual sound sources on the median plane, in particular sound sources in front of the user, are often subject to false localization due to the lack of interaural differences, as has already been mentioned before. Sound source positions that very closely mimic the incidence direction of sound of sound sources that are arranged on the median plane, are often very well suited for the induction of natural pinna resonances supporting specific directions on the median plane. Therefore, deviations of the angle $\alpha$ from the plane parallel to the median plane, as illustrated in FIG. 17 in dashed lines (F, R, T and B fall into this plane), may be chosen between about 0° and 40° for such cases in which the sound source arrangement is not limited in any way by the user's head.

As has already been described above, very early reflections of sound that is emitted by a sound source that is used for generating directional pinna resonances may be caused by objects close to the pinna. Such very early reflections are detrimental to the introduction of strong natural directional pinna cues if they reach the pinna from considerably different directions than the direct sound. Therefore, such reflections should be avoided or at least reduced as far as possible. Measures that may be taken in order to reduce reflections that are directed towards the pinna include the avoidance of surface area orientations around the pinna that re-direct sound from any sound source towards the pinna, concealing any mechanical structures that are arranged behind the user's ear behind the pinna to shade them against direct sound, application of sound absorbing or low reflective material to structures that are prone to directing reflections at the pinna, and controlling sound source radiation patterns, thereby reducing sound radiation towards obstacles that would reflect sound towards the pinna. If reflections which cannot be avoided result in a small shift of the direction associated with the generated pinna cues from the intended direction, the position of the sound source may be shifted in order to compensate for the deviation from the desired direction associated with the pinna cues. If, for example, the elevation angle of a source direction associated with pinna cues induced by a frontal sound source is higher than desired, the position of the physical sound source may be shifted to a lower elevation angle to compensate for the deviation.

There are several parameters that can alter directional pinna cues. These parameters include the individual perception characteristics of the user which may lead to variations of the perceived image elevation angle, and reflections on parts of the headset arrangement. Generally, individual directional pinna resonance cues from the front support and improve the generation of sound images in the frontal hemisphere of the user and thereby also the generation of sound images at a centered position in front of the user, even if the incidence angle at which the sound source is positioned does not exactly match the elevation angle of the desired sound image.

The frame of the sound structure may have an essentially rounded or essentially oval shape. The rounded or oval shape, however, is only an example. Generally, the sound structure may have any suitable form, e.g., circular, rectangular or any other regular or irregular form. The form of the sound structure in combination with the sound source arrangement may be chosen such that reflections of the sound on the sides of the sound structure opposite to the sound sources are reduced. The form of the sound structure may be chosen such that the pinna is kept essentially open and such that it allows the sound sources to be positioned at effective angles with respect to the horizontal plane to obtain the desired sound direction. However, there are usually constraints when choosing an optimum shape of the sound structures. Such constraints may be given by the shape of the support structure. The desired target sound field is unidirectional, meaning that reflections into the pinna or at least the concha region are altogether avoided. If a direct sound emanated from the frontal part of the sound structure reaches the concha region and is accompanied by a reflection into the concha region from above or behind the pinna, a directional cue may be weakened or be destroyed altogether. The more or the stronger the reflections, the less clear directional pinna cues will be left. Therefore, reflections may be reduced in order to be able to provide strong directional pinna cues.

A possibility to reduce reflections into regions of the pinna or especially the concha, is to direct the reflections away from the pinna or concha. The external surface of sound structures or support structures may comprise a plurality of external surface sections. These external surface sections may for example be so small that their surface area is approximately plain (e.g. less than 1° variation in the direction of the vertical on any part of the surface area). External surface sections of a sound structure or support structure arranged around the ear may either be angled such that the verticals of these surface sections point in a direction towards the pinna or concha or in a direction that does not point towards the pinna or concha. In order to minimize reflections into the concha region, external surface sections that point towards the pinna or concha may be avoided or their surface area minimized. This is of particular importance for surface sections with a direct line of sight towards the pinna or especially the concha, or, in other words, from which a straight line can be drawn towards a part of the pinna or concha without intersection of other objects in between. External surface sections around the pinna may, for example, be angled at an angle <90°, <70° or <50° with respect to the median plane in order to direct reflections away from the pinna. For example more than 30%, more than 50% or more than 70% of the surface sections with a direct line of sight towards the pinna or concha may be angled at an angle <90°, <70° or <50° to the median plane such that their vertical does not point towards the pinna or concha. Generally the sound intensity of reflections when they reach the concha will be lower the more distant the surface section is, which directed the reflection towards the concha. In another example, more than 30%, more than 50% or more than 70% of the surface sections with a direct line of sight towards the pinna or concha may be angled at an angle <90°, <70° or <50° to the median plane such that their vertical does not point towards the pinna or concha only if these surface sections fall into a radius of, e.g., 10 cm or 15 cm around the concha.

A further possibility is to arrange at least one sound source that comprises surface sections with a direct line of sight towards the pinna or concha such that these surface sections face away from the pinna or concha. If, for example, the sound source is a loudspeaker with a membrane for sound radiation, the loudspeaker may be oriented such that the loudspeaker membrane and/or the main sound radiating lobe of the loudspeaker are tilted away from the pinna or concha. Loudspeakers may be arranged such that the loudspeaker membrane is arranged at an angle 90° with respect to the median plane. Loudspeakers generally radiate sound essentially uniformly at low frequencies and merely focus sound into a main radiation lobe at high frequencies. This may result in an amplitude response at the pinna, with falling levels towards high frequencies, which may simply be compensated by suitable equalizing filters that boost high frequencies for which loudspeakers usually provide enough headroom in the available sound pressure level.

An additional or alternative possibility for reducing reflections is the use of sound damping or sound absorbing materials. For example, highly sound absorbing foam materials exist that may be applied to any surface on the sound structure or support structure, most effectively on any surfaces facing the pinna. For example, sound absorbing materials based on glass mineral wool or cotton may be used. The so-called sound absorption coefficient, which describes the fraction of sound energy absorbed by a material, is known as a performance metric for sound absorbing materials. The sound absorption coefficient generally ranges between 0 (no absorption) and 1 (full absorption), although some measurement methods for determining the sound absorption coefficient may result in values >1. Usually the sound absorption coefficient is frequency-dependent and often tends to increase from low to high frequencies. For the application of sound absorbing materials within the proposed headset arrangements the sound absorption coefficient may be greater than 0.5 for frequencies between 2 kHz and 15 kHz or greater than 0.3 for frequencies between 4 kHz and 10 kHz. However, it should be noted that the absorption coefficient generally depends on the thickness of the sound absorbing material, the incident and reflection angles as well as the measurement method that is used to determine the absorption coefficient. For some materials the maximum sound absorption is reached at an intermediate frequency, while sound absorption decreases for lower and higher frequencies. Therefore, the sound absorption may vary over the surface of the headphone arrangement that is covered with sound absorbing material as well as with the frequency content of the sound.

Figure 18:
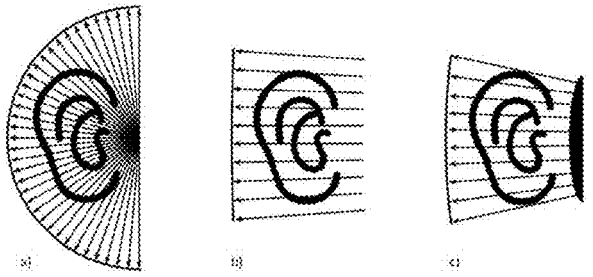
FIG. 18 schematically illustrates sound emitted by a point source and by an extended sound source.

A single loudspeaker or sound source generally resembles a point source, as is schematically illustrated in FIG. 18, example a). A point source generally generates a spherical sound wave if the point source is arranged relatively close to the ear. When the point source is arranged comparatively far away from the ear, as is illustrated in example b), the sound wave is relatively plane. A larger (extended) sound source, as is schematically illustrated in FIG. 18, example c), radiates an approximately plane sound wave. In one embodiment, the headset arrangement comprises an extended sound source. The extended sound source may provide large radiating membrane dimensions compared to the size of the pinna, which increases the directivity of the sound source and generates an approximately plane sound wave. Sound source directivity may be controlled by adapting the loudspeaker membrane dimensions, for example. The larger the size of the loudspeaker membrane, or more specifically the sound emitting part of the membrane in a certain dimension, the more focused the sound beam emitted by the loudspeaker in the corresponding direction. Focused sound sources usually cause fewer reflections than omni-directional sound sources. As the directivity of loudspeakers depends on the size of the sound radiating surface (membrane) relative to the wavelength of the emitted signal, especially higher frequencies (e.g., above 4 kHz) benefit from increased directionality of the loudspeaker. Loudspeakers that are large as compared to the size of the pinna (or concha), generally better resemble the situation in the far field of a source. In such situations the sound wave within the dimensions of the pinna is predominantly travelling in one direction instead of expanding in all directions. FIG. 18 demonstrates the differences between small sound sources (approximated by a point source in example a) and an extended sound source which has equal vertical dimensions as the pinna (see example c). As the curvature of the sound field arriving at the ear is an indicator of the distance between the source and the ear and changes drastically in the near field of the source, a sound field with an approximately flat wave front may be used to support the generation of distant virtual sources. A large vertical radiation area may be obtained by arranging two or more loudspeakers in proximity to each other and perform parallel playback on these two or more loudspeakers.

Remaining reflections may still adversely bias the perceived source localization, especially the elevation angle of the sound image. An additional or alternative possibility is to shift the sound source position along the opposing boundaries of the sound structure to compensate for the elevation bias. Users generally tend to locate frontal sound sources above the head or in front of the forehead when headphone playback with HRTF-based filtering is implemented. A comparable effect can be observed with normal stereo loudspeaker playback where the phantom image between the loudspeakers is often perceived above the physical loudspeaker position. One possibility to compensate for such phantom image or virtual source elevation effects for playback over the proposed headphone arrangements is to position the sound sources that are intended for generating frontal directional pinna cues associated with an elevation angle of 0°, below the horizontal plane through the ear canal to compensate for the tendency of increased elevation angle perception.

For example, one or more sound sources may be arranged below the horizontal plane on a frontal part of the sound structure such that they provide sound to the ear of the user from a lower frontal direction. If only one sound source is arranged below the horizontal plane on a frontal part of the sound structure, its relevant direction of sound propagation towards the concha may be angled with respect to the horizontal plane. In one example, its relevant direction of sound propagation towards the concha may be angled at an angle of about 10° to about 40° with respect to the horizontal plane. If two or more sound sources are arranged on the frontal part of the frame below the horizontal plane, the relevant direction of sound propagation towards the concha of each individual sound source may be angled with respect to the horizontal plane, and an average angle of the respective relevant directions of sound propagation may be between about 10° and about 40°.

Figure 20A:
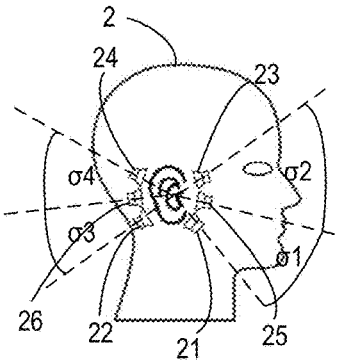
FIGS. 20A to 20C schematically illustrate further examples of sound source positioning with respect to the user's ear.
Figure 20B:
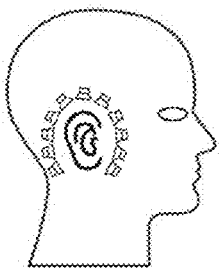
Figure 20C:
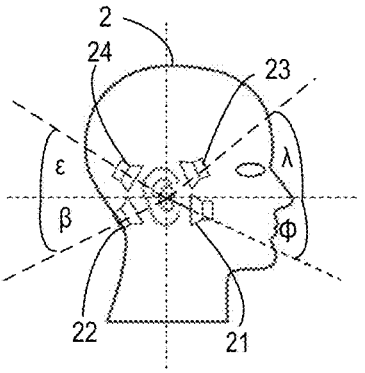

FIGS. 20A to 20C schematically illustrate further examples of sound source positioning. Sound sources, generally, may be positioned all around the pinna, with two or more pairs of sound sources opposing each other, as has been described before and as is illustrated in FIG. 14A. However, as is illustrated in FIG. 20A, sound sources may, for example, only be positioned in front of the user's ear and behind the user's ear. Several sound sources that are positioned close to each other may optionally form a larger (extended) sound source, as has been described with respect to FIG. 18, example c) before. In the arrangement of FIG. 20A, a first sound source 21, a third sound source 23 and a fifth sound source 25 are arranged in front of the user's ear and, therefore, the user's pinna. A second sound source 22, a fourth sound source 24 and a sixth sound source 26 are arranged behind the user's ear and, therefore, the user's pinna. Neighboring sound sources may be arranged such that an angle σ between their relevant directions of sound propagations is between 10° and 50°. For example, a first angle σ1 between the relevant direction of sound propagation of the first sound source 21 and the relevant direction of sound propagation of the fifth sound source 25 may be between 10° and 50°. The same applies for the angles σ2, σ3 and σ4 between the relevant directions of sound propagation of other neighboring sound sources. As is illustrated in the example of FIG. 20B, further sound sources may be arranged above the user's ear and optionally form one or more extended sound sources. The arrangement illustrated in FIG. 20C is similar to the arrangement of FIG. 16A. The externalization of the sound image may be further improved by additional signal processing in combination with the headset arrangements disclosed herein. Furthermore, signal processing may be applied to control the azimuth and elevation angles of virtual sources, as well as the distance of the virtual sources from the user. However, even without additional signal processing, partial externalization of the sound image may be achieved with the sound source arrangements as disclosed herein and, even more importantly, when using the sound source arrangement according to the present disclosure, a user may distinguish the different directions of sound sources in the front, the back, above or below that are associated with the different sound sources.

It should be noted that the proposed headset arrangements may include multiple sound sources that may be individually controlled by individual electrical sound signals. Furthermore, the voice coil impedance and/or efficiency of loudspeakers of the sound sources may not be compatible with standard headphone amplifiers, as, for example, headphone amplifiers as provided in many smart phones today. Therefore, the headset arrangement may include at least one electronic driving unit that is configured to receive an input signal and to apply the conditioned input signal as a driving signal to a single or multiple loudspeakers. Furthermore, the processing of the electrical sound signals may be required in some applications in order to achieve certain sound quality or sound spatiality characteristics. Therefore, the headset arrangement may include at least one signal processing unit that is configured to receive at least one input signal, to process the at least one input signal and to emit at least one processed input signal to at least one electronic driving unit.

According to one example, a headset arrangement for virtual reality or augmented reality applications is configured to generate natural directional pinna cues. The arrangement comprises a support structure configured to be arranged on a user's head and to hold a display in front of the user's eyes. The support structure comprises at least one ear cup comprising a frame that is configured to be arranged to at least partially encircle the ear of the user, thereby defining an open volume about the ear of the user, at least a first sound source and a second sound source arranged within the frame of the ear cup, wherein the first and the second sound source are arranged such that their main directions of sound propagation are directed in essentially opposing directions.

According to a further example, the first sound source and the second sound source emit the same content for frequencies between about 4 and about 15 kHz.

According to a further example, an angle Ψ between the main direction of sound propagation of the first sound source and the main direction of propagation of the second sound source is between about 0° and about 10°, between about 0° and about 30°, between about 0° and about 50°, or between about 0° and about 90°.

According to a further example, the arrangement further comprises a third sound source arranged within the frame of the ear cup, wherein the first, second and third sound sources are arranged at the corners of an isosceles triangle, and wherein a symmetry axis of the isosceles triangle runs across the pinna or the concha of the user.

According to a further example, the at least one ear cup is integrated into the support structure.

According to a further example, the ear cup comprises at least one extension that is connected to the support structure, wherein the at least one extension and at least a section of the support structure form the frame of the ear cup.

According to a further example, the first sound source and the second sound source comprise at least one of a loudspeaker, a sound canal, a sound tube, a wave guide and a reflector.

According to a further example, at least one of the first sound source and the second sound source comprises a loudspeaker that is arranged at a first end of a sound canal, and wherein a sound outlet at a second end of the sound canal is configured to emit sound into the open volume about the ear of the user.

According to a further example, the ear cup comprises surfaces that are oriented essentially towards the pinna and surfaces that are oriented essentially away from the pinna, wherein at least parts of the surfaces oriented essentially towards the pinna comprise a sound absorbing material, the sound absorbing material being configured to reduce the intensity of sound that is emitted by the sound sources and reflected towards the pinna of the user.

According to a further example, the frame comprises a plurality of sections, and wherein at least one section is arranged behind the pinna such that it is shaded from direct sound emitted by a sound source arranged on the frontal part of the ear cup.

According to a further example, the inner walls of the frame comprise a plurality of sections, wherein the inner walls of the frame are walls that are essentially facing the open volume within the frame, and at least sections that are arranged opposite to a sound source are at least partially beveled at an angle >20° and <90° with respect to a median plane to direct reflections away from the user's head, wherein the median plane crosses the user's head midway between the user's ears, thereby dividing the head exactly in a left side and a right side.

According to a further example, at least two sound sources are arranged adjacent to each other to form an extended sound source that is configured to emit an approximately plane sound wave.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as signal processing components with one or more of the sound sources discussed above. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

While various embodiments have been described, it will be apparent to those of ordinary skill in the art that many more embodiments and implementations are possible within the scope of the disclosure. Accordingly, the disclosure is not to be restricted except in light of the attached claims and their equivalents.

The invention claimed is:

1. A headset arrangement for virtual reality, augmented reality, or mixed reality applications that is configured to induce natural directional pinna cues, the arrangement comprising a support structure configured to be arranged on a head of a user and to hold a display in front of eyes of the user, the support structure comprising for each ear of the user:

a frame that, when the support structure is arranged on the head of the user, is configured to form an open structure around at least one ear of the user, wherein the frame only partly encircles the at least one ear of the user, and wherein the open structure is open toward a side that faces away from the head of the user, at least a first sound source and a second sound source, wherein, when the support structure is arranged on the user's head, the first sound source and the second sound source are arranged such that at a concha of the user a primary sound incidence direction of sound emitted by the first sound source is opposing to a primary sound incidence direction of sound emitted by the second sound source such that an angle $\psi$ between the primary sound incidence directions of sound emitted by the first and second sound sources is $180°\pm30°$, wherein the primary sound incidence direction is the direction from which the sound emitted by a sound source reaches the user's concha for a first time, and when the support structure is arranged on the head of the user, wherein the first sound source is arranged in front of a user's pinna and the second sound source is arranged behind the user's pinna, and wherein an angle $\Phi$ between the primary sound incidence direction of the first sound source and a horizontal plane is between 0° and 50°, wherein the horizontal plane runs horizontally through a geometric center of the concha of the user, and the angle $\Phi$ opens towards a frontal direction (F), wherein the frontal direction (F) is arranged in front of a frontal plane which equally divides anterior aspects and posterior aspects of the user's head and which lies at a right angle to the horizontal plane.

2. The headset arrangement of claim 1, wherein the first sound source and the second sound source each comprise:

one or more loudspeakers, one or more sound canal outlets, one or more sound tube outlets, one or more wave guide outlets, and/or one or more reflectors.

3. The headset arrangement of claim 2, further comprising a third sound source, wherein, when the support structure is arranged on the user's head, the third sound source is arranged in front of the user's pinna, an angle $\lambda$ between a primary sound incidence direction of the third sound source and the horizontal plane is between 10° and 50°, the primary sound incidence direction of the third sound source and the horizontal plane intersect at the geometric center of the user's concha, and the primary sound incidence direction of the third sound source is directed towards the horizontal plane from above the horizontal plane.

4. The headset arrangement of claim 3, further comprising a fourth sound source, wherein, when the support structure is arranged on the user's head, the fourth sound source is arranged behind the user's pinna, an angle $\varepsilon$ between a primary sound incidence direction of the fourth sound source and the horizontal plane is between 10° and 50°, the primary sound incidence direction of the fourth sound source and the horizontal plane intersect at the geometric center of the user's concha, the primary sound incidence direction of the fourth sound source is directed towards the horizontal plane from above the horizontal plane, an angle $\beta$ between the primary sound incidence direction of the second sound source and the horizontal plane is between 10° and 50°, the primary sound incidence direction of the second sound source and the horizontal plane intersect at the geometric center of the user's concha, the primary sound incidence direction of the second sound source is directed towards the horizontal plane from below the horizontal plane.

5. The headset arrangement of claim 4, further comprising a fifth sound source and a sixth sound source, wherein, when the support structure is arranged on the user's head, the first sound source, the third sound source, and the fifth sound source are arranged in front of the user's pinna, an angle between the primary sound incidence directions of two neighboring sound sources arranged in front of the user's pinna is between 10° and 50°, the second sound source, the fourth sound source, and the sixth sound source are arranged behind the user's pinna, and an angle between the primary sound incidence directions of two neighboring sound sources arranged behind the user's pinna is between 10° and 50°.

6. The headset arrangement of claim 1, wherein the sound sources are arranged distant to a first plane such that their primary sound incidence directions towards the geometric center of the user's concha are at an angle $\alpha$ with respect to the first plane, wherein the first plane runs through a geometric center of the user's ear and is parallel to a median plane, wherein the median plane crosses the user's head midway between the user's ears, thereby dividing the head into a mirror-symmetrical left half side and right half side, and wherein the angle $\alpha$ is between 0° and 45° for all sound sources.

7. The headset arrangement of claim 1, wherein:

at least two sound sources are configured to direct a same sound signal towards the geometric center of the user's concha for frequencies between 4 kHz and about 15 kHz; and/or at least two sound sources are controlled by a same signal or an identical signal at least between 4 kHz and 15 kHz.

8. The headset arrangement of claim 1, wherein at least one of the sound sources comprises a loudspeaker that is arranged at a first end or at an intermediate section of a sound canal, sound tube, or wave guide, and wherein a sound outlet at a second end of the sound canal, sound tube, or wave guide is configured to emit sound into an open volume about the ear of the user.

9. The headset arrangement of claim 1, wherein the support structure comprises first surface sections that, when the support structure is arranged on the user's head, are oriented towards the user's pinna and second surface sections that are oriented away from the user's pinna, and wherein at least parts of the first surface sections oriented towards the user's pinna comprise a sound absorbing material, the sound absorbing material being configured to reduce an intensity of sound that is reflected towards the user's pinna by the first surface sections.

10. The headset arrangement of claim 1, wherein the support structure comprises surface sections that are oriented towards the user's pinna, wherein the support structure comprises a plurality of sections, and wherein at least one section is arranged behind the user's pinna such that surface sections of that section which are oriented towards the user's pinna are shaded from direct sound emitted by a sound source arranged in front of the user's pinna.

11. The headset arrangement of claim 1, wherein the support structure comprises surface sections that are oriented towards the pinna of the user and that have a direct line of sight towards the pinna or the concha of the user, and surface sections that are oriented away from the pinna of the user, and wherein more than 30%, more than 50%, or more than 70% of the surface sections with the direct line of sight towards the pinna or the concha of the user are angled at an angle <90°, <70°, or <50° towards a median plane such that their vertical points away from the pinna or concha of the user if these surface sections fall within a radius of 10 cm around the concha of the user, wherein the median plane crosses the head of the user midway between the ears of the user, thereby dividing the head into a mirror-symmetrical left half side and right half side.

12. The headset arrangement of claim 1, wherein at least one of the sound sources is at least one loudspeaker, the at least one loudspeaker being arranged such that at least one of:

a main direction of sound radiation of the loudspeaker is parallel to or is directed away from a median plane, wherein the median plane crosses the head of the user midway between the ears of the user, thereby dividing the head into a mirror-symmetrical left half side and right half side, and a first side of a membrane of the loudspeaker is facing a direction that is parallel to the median plane or facing away from the median plane.

13. The headset arrangement of claim 1, further comprising one or more straps arranged to hold the headset arrangement on the head of the user when the headset is worn by the user, at least one of the straps coupled to the display to hold the display in front of the eyes of the user when the headset is worn by the user.

14. The headset arrangement of claim 1, wherein, when the support structure is arranged on the head of the user, the support structure is open toward a lateral direction within the horizontal plane facing away from the head of the user, wherein the lateral direction is perpendicular to a median plane.

15. The headset arrangement of claim 1, wherein, when the support structure is arranged on the head of the user, the support structure is open toward a direction below at least one ear of the user within a plane that is parallel to a median plane and runs through the user's concha.

* * * * *